US006681786B2

(12) United States Patent
Ju

(10) Patent No.: US 6,681,786 B2
(45) Date of Patent: Jan. 27, 2004

(54) DETACHABLE MEANS FOR INSTANT SETUP FOLDABLE TENT

(75) Inventor: Dong Soo Ju, Seoul (KR)

(73) Assignee: Baejin Corporation, Seoul (KR)

( * ) Notice: Subject to any disclaimer, the term of this patent is extended or adjusted under 35 U.S.C. 154(b) by 0 days.

(21) Appl. No.: 10/039,988

(22) Filed: Jan. 3, 2002

(65) Prior Publication Data

US 2003/0084933 A1 May 8, 2003

(30) Foreign Application Priority Data

Nov. 8, 2001 (KR) ..... 10-2001-0069533

(51) Int. Cl.[7] ..... E04H 15/62

(52) U.S. Cl. ..... 135/120.3; 135/98; 135/118

(58) Field of Search ..... 135/135, 156, 135/128, 132, 133, 136, 120.1, 120.2, 120.3, 118, 120.4, 119, 116, 138, 143, 144, 130, 161

(56) References Cited

U.S. PATENT DOCUMENTS

| | | | | | |
|---|---|---|---|---|---|
| 4,193,413 | A | * | 3/1980 | Watts et al. | 135/98 |
| 5,002,083 | A | | 3/1991 | Kim | 135/98 |
| 5,046,882 | A | | 9/1991 | Ju | 403/170 |
| 5,195,551 | A | | 3/1993 | Ju | 135/102 |
| 5,241,706 | A | * | 9/1993 | Netz | 2/66 |
| 5,333,634 | A | * | 8/1994 | Taylor | 135/98 |
| 5,421,355 | A | * | 6/1995 | Cantwell | 135/120.3 |
| 5,597,007 | A | | 1/1997 | Ju | 135/124 |
| 5,615,699 | A | * | 4/1997 | Lee | 135/118 |
| 5,662,133 | A | * | 9/1997 | Guido, Jr. | 135/119 |
| 5,884,646 | A | | 3/1999 | Ju | 135/135 |
| 5,901,726 | A | * | 5/1999 | Gal et al. | 135/120.3 |
| 6,021,795 | A | * | 2/2000 | Long et al. | 135/98 |

FOREIGN PATENT DOCUMENTS

CA 2217788 * 4/1999

OTHER PUBLICATIONS www.tadgear.com web site; Mountain Hardwear tent; adjustable fly attachment feature; site last updated Feb. 20, 2002.*

* cited by examiner

*Primary Examiner*—Janet M. Wilkens
(74) *Attorney, Agent, or Firm*—Thomas C. Feix

(57) ABSTRACT

A tent detachable means for an instant setup foldable tent is disclosed. In this instant setup foldable tent, while retaining the advantages of the instant setup foldable tent such as speediness and convenience, a tent detachable means is provided, making it possible to attach and detach the tent to and from the tent frame, enabling the user to pitch the tent or the fly selectively or both, thus promoting the usefulness of the tent. The instant setup foldable tent includes a plurality of foldable tent frames secured to a hub, and a tent cloth is coupled to the plurality of the foldable tent frames by a plurality of hooks. The tent includes a tent detachable means attached between a lower portion of the tent cloth and a lower portion of each pole of the foldable tent frames making it possible to attach and detach the test cloth to and from the frames, leaving tent frame untouched; and further includes a pole-securing means provided for the poles to be secure to the ground firmly.

10 Claims, 3 Drawing Sheets

DETACHABLE MEANS FOR INSTANT SETUP FOLDABLE TENT

FIELD OF THE INVENTION

The present invention relates to a tent detachable means for an instant setup foldable tent. More specifically, the present invention relates to a tent detachable means for an instant setup foldable tent in which the tent frame is coupled to the tent cloth by means of hooks in such a manner that a tent detachable means if disposed between the pole of the tent frame and the lower portions of the tent cloth. In the case where only a fly is to be installed, the tent is separated form the tent frame.

BACKGROUND OF THE INVENTION

There is a lot of prior art of a foldable tent, including Korean Utility Model Registrations 48630 (dated Jul. 4, 1990; 48717 (dated Jul. 7, 1990); 60228 (dated Nov. 1, 1991); 95072 (dated Mar. 6, 1996); 109306 (dated Sep. 5, 1997); 129575 (dated August 1998); and 149956 (dated Mar. 31, 1999). The present application is the registrant of all of these registered utility models. There is also prior art of a foldable tent.

When pitching these conventional foldable type tents, a plurality of folded frame poles are unfolded by one touch manipulation, and the tent cloth is also unfolded. Thus the tent can be instantly installed, and therefore, there is speediness and convenience in installing a tent.

Further, in case where a fly is coupled to the frame, both the tent and the fly are assembled simultaneously, thereby furthering the convenience in use.

Thus if a tent is with a foldable frame is to be pitched by one touch manipulation, the frame and the tent should be kept coupled all the time by a coupling means so that the tent cloth can be unfolded at the same time when the frame is unfolded. Thus owing to the coupled state between the frame and the tent cloth, a tent is instantly installed.

Once example of the conventional foldable tent is illustrated in FIG. 6. As shown in this drawing, an insertion part p" with a pair of latches p is formed on the lower tip of the pole of the tent frame f. This insertion part p" is coupled to a slot h which has a securing piece s having a ring r for securing the tent. The ceiling part of the tent cloth is flexibly coupled to the frame f by means of a hook u.

This conventional foldable tent can be quickly and conveniently installed in an open field, in contrast with the regular types of tents in which a plurality of poles are assembled and then the test cloth is couple tot he plurality of poles by means of loops or threading through the sleeves.

Meanwhile, in the conventional foldable tent, the tent is provided with securing means to secure the tent cloth to the ground, and the frames are secured to these securing means. Therefore, as the frame is assembled to the tent integrally, the two are inseparable. Therefore, even when the user wants to install only the fly, as the user cannot separate the frame from the tent, the user cannot install the fly independently.

Of course, because the roof part of the tent cloth is coupled to the frame by means of loops, the roof part can be easily detached. However, the lower part of the pole is inseparably coupled to the tent securing piece, and therefore, if the fly is to be installed, the whole tent, including the fly, has to be installed. Thus, despite the convenience and the simplicity in use, the scope of use of these conventional foldable tents is limited.

These problems are typical in the foldable tent, and these problems are not seen in the regular foldable tents. In the ordinary non-one touch installation tent, where the tent and the frame are separable, there is the disadvantage that the tent cannot be installed by one-touch manipulation.

SUMMARY OF THE INVENTION

The present invention is intented to overcome the above-described disadvantages of the conventional technique.

Therefore it is an object of the present invention to provide a highly efficient instant setup foldable tent which not only retains the advantages of the foldable tent such as speediness and convenience in pitching a tent but provides a tent detachable means and a pole-securing means between the tent cloth and the lower portion of the tent frame pole, making it possible to pitch a tent as well as to pitch a fly without a tent.

In achieving the above object, the instant setup foldable tent according to the present invention comprises: a plurality of foldable tent frames movably secured to a hub; and a tent cloth coupled though a plurality of hooks to the foldable tent frames so as to unfold the tent frames by a one-touch operation to install the tent.

The tent further comprises: a tent detachable means attached to the tent cloth between a lower portion of the tent cloth and a lower portion of each pole of the foldable tent frame so as to make it possible to attach and detach the tent cloth to and from the tent frame; and a pole-securing means provided for the pole to be secured to the ground, whereby the poles can be secured independently to the ground even when the tent cloth is detached from the tent frame.

In this way the poles and the tent cloth are coupled by means of the tent detachable means of the present invention so as to install the tent by a one-touch manipulation; the frame and the tent cloth can be detached using the detachable means; and only the frames can be installed on the ground by securing the frames to the ground by means of the pole-securing means provided for the pole.

The tent detachable means according to the present invention are provided by employing the ordinary hooks, rings, buckles or other existing devices available. The pole-securing means may be selected from the ordinary devices for securing the tent pole to the ground, such as stakes and pegs. The stake or a peg is inserted through ring, which is formed on the tent-securing piece, and is driven into the ground. The tent-securing piece has a hole, and into this hole the pole is inserted and secured to the ground. The tent securing piece is linked to the tent detachable means.

Thus, according to the present invention, the advantage that the tent and the fly can both be installed by a one-touch manipulation is maintained, and besides, the tent cloth can be detached form the tent frame, leaving the tent frame untouched, so as to install only the fly, thus offering an added advantage in use, using it as a sun shelter. Thus, the usefulness of the instant setup foldable tent is promoted, and therefore, the tent can be used in an easier and more convenient manner than the conventional foldable tents.

The present invention is applicable to general foldable tents, regardless of the structures and shapes of the tent.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
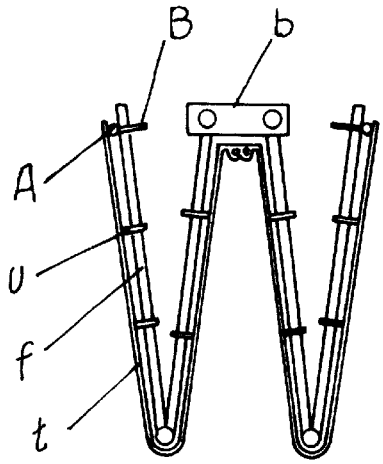
FIG. 1 schematically illustrates the folded state of the instant setup foldable tent according to the present invention.
Figure 2:
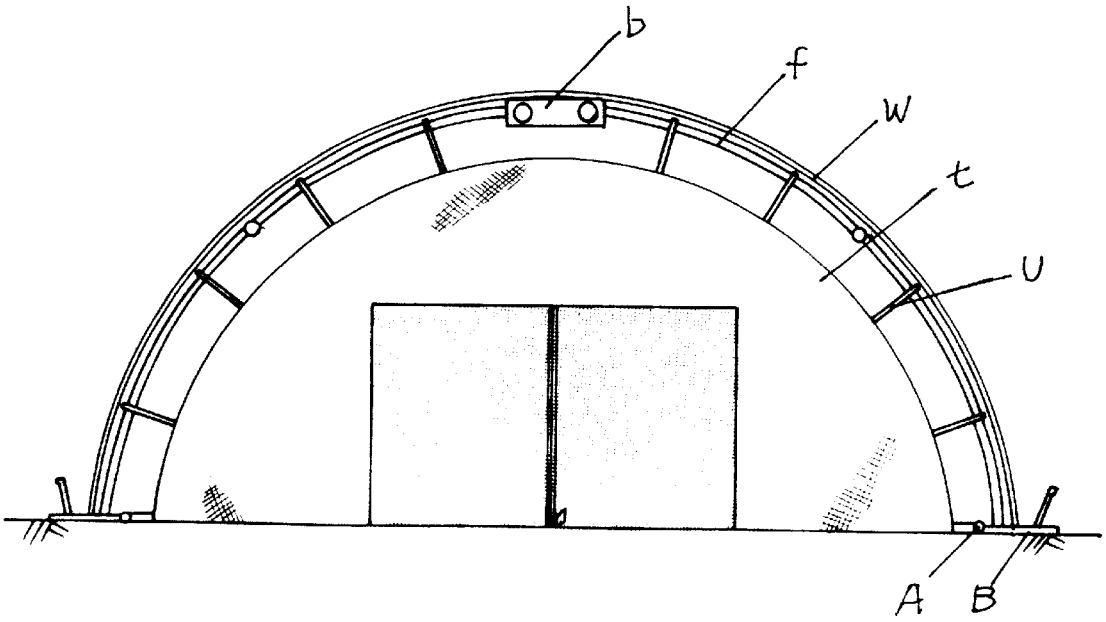
FIG. 2 is a frontal view showing a state in which the tent cloth is coupled to the lower portion of the poles of the tent frame by a tent detachable means when the instant setup fold tent of the present invention is installed.
Figure 3:
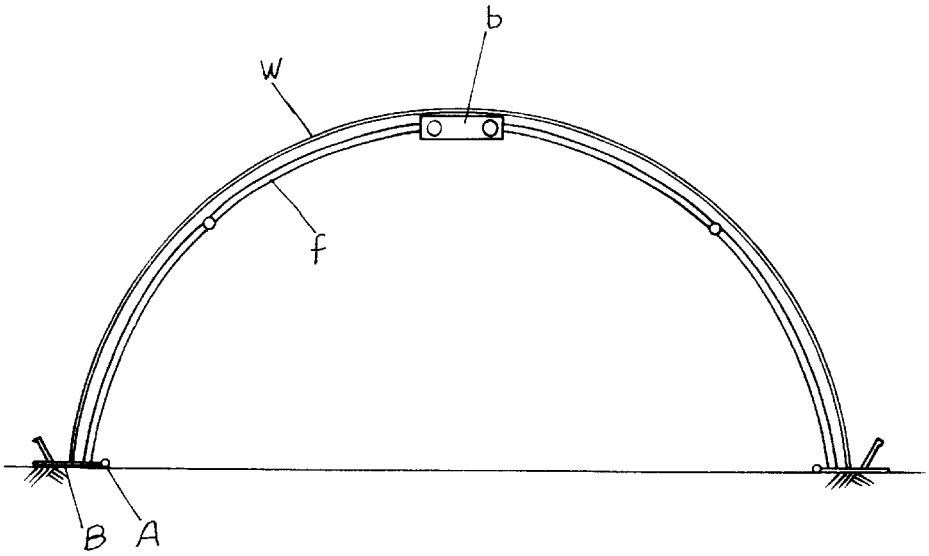
FIG. 3 is a frontal view showing a state in which the tent cloth is detached form the poles of the tent through the tent detachable means when only the fly of the instant setup foldable tent of the present invention is installed.
Figure 4:
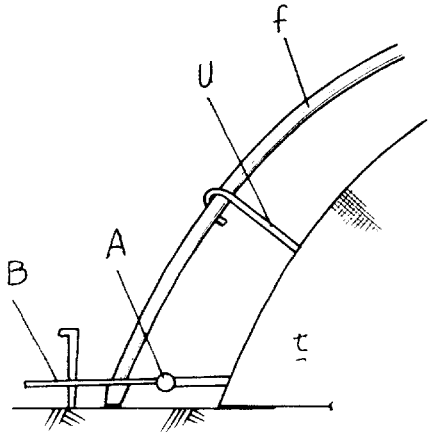
FIG. 4 schematically illustrates a state in which the pole of the tent is secured to the ground by using a securing means, and the tent cloth is coupled by means of the detachable means.

FIG. 1 schematically illustrates the folded state of the instant setup foldable tent frames according to the present invention. FIG. 2 is a frontal view showing a state in which the tent cloth is coupled to lower portion of the poles of the tent frame by a tent detachable means when the instant setup foldable tent of the present invention is installed. FIG. 3 is a frontal view showing a state in which the tent cloth is detached from the poles of the tent through the tent detachable means when only the fly of the one-touch installable tent of the present invention is installed.

That is, a plurality of foldable actuate elastic frames f are connected to a hub b. A roof portion of a tent t is coupled to these frames f by means of a plurality of hooks h. Thus, the frames f and the tent t are unfolded instantly by a one-touch operation to pitch the tent at one stroke.

A tent detachable means A is attached between the lower portion of each of poles p of the frames f and the lower portion of the tent cloth t. A pole-securing means B is provided to the lower portion of the pole p.

Unlike the conventional foldable tent, the tent of the present invention secures its frames to the ground by means of the pole-securing means. Then the tent cloth is coupled to the frames which have been secured to the ground. Therefore, the frames are not restricted by the tent cloth, and therefore, the frames themselves can be installed on the ground independently, so that only the fly can be installed over the frames if desired.

Figure 7:
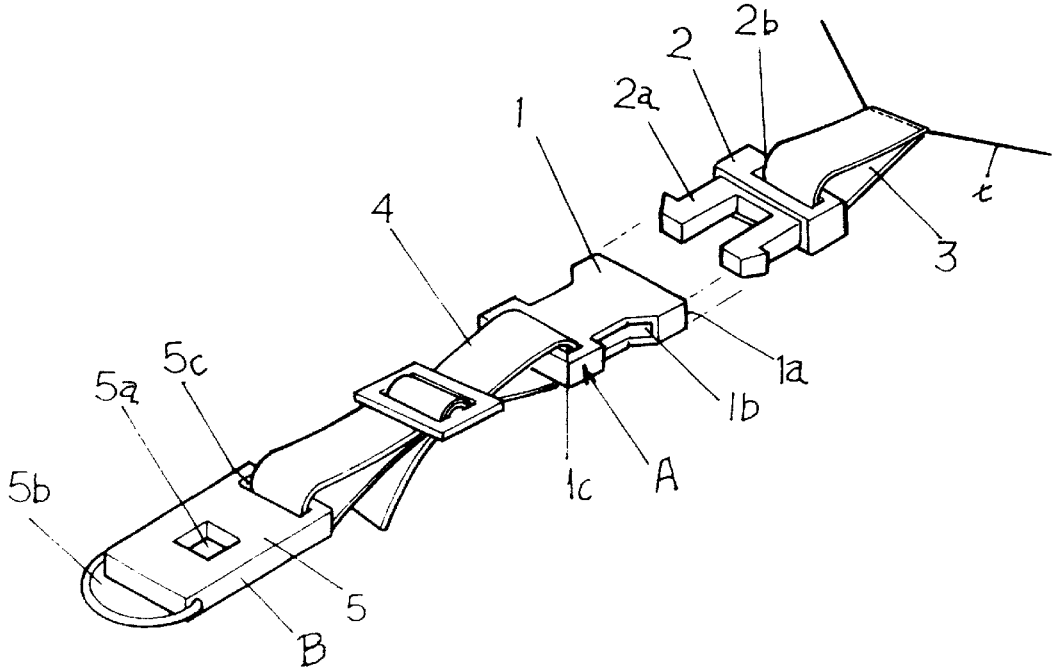
FIG. 7 illustrates the pole-securing means linked to the tent detachable means according to the present invention.

In the present invention, the tent detachable means A is independent from the pole-securing means B, but the two of these means can be physically connected together. FIG. 7 illustrates this embodiment in which the tent detachable means A is physically connected to the pole securing means B.

When the tent of the present invention is installed as shown in FIG. 2 the tent detachable means A attached to the tent cloth are connected between the frames f and the tent cloth t. Accordingly, the frames f together with the tent cloth t can be unfolded from the folded state of FIG. 1 like an umbrella by one touch manipulation by the elasticity of the springs (not illustrated).

Then the unfolded frames f are secured to the ground by means of the pole-securing means B, and the poles p of the frames f are further secured to the ground by the stakes driven into the ground through the rings of the pole-securing means (B), securing the tent frames firm enough to stay stable even against a strong wind.

Figure 5:
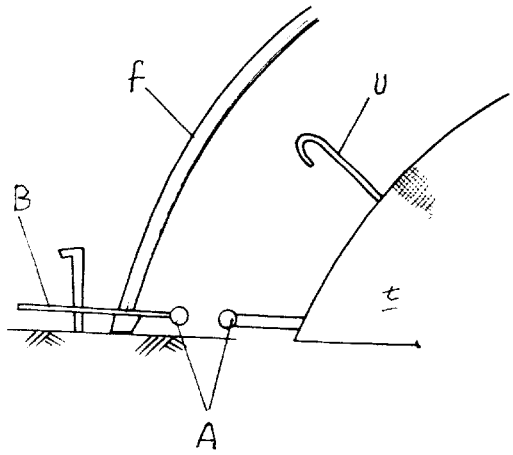
FIG. 5 schematically illustrates a state in which the pole of the tent is secured to the ground by using securing means, and the tent cloth is detached by means of the detachable means.

As shown in FIG. 3, in the case where only the fly is to be installed, the tent cloth t is separated in the first place from the frames by means of the tent detachable means A as shown in FIG. 5 and then, only the frames f are unfolded by one touch manipulation. Then the poles of the frames f are secured to the ground by means of the pole-securing means B, and then, the fly w is installed over the frames f.

EXAMPLE

FIG. 7 illustrates the pole-securing means B as to how it is to be linked to the tent detachable means A in the tent according to the present invention.

Here, the tent detachable means A takes the form of an ordinary buckle, while the pole securing means B is a known-type of securing piece which is used to secure the poles of the tent to the ground.

The tent detachable means A includes: a buckle 1 having an insertion hold 1*a* and an engaging step 1B; and a coupling member 2 with a pair of hooks 2*a* protruding symmetrically to be inserted into the insertion hold 1*a* and to be engaged to the engaging step 1*b*.

The coupling member 2 further includes a hold 2*b* through which a connecting loop 3 passes, and the connecting loop 3 is sewed up to the lower edge of the tent cloth t. Meanwhile, the buckle 1 has a hole 1*c*, and a band 4 passes through the hole 1*c* to be connected to a pole-securing piece 5 of the pole-securing means B.

Figure 6:
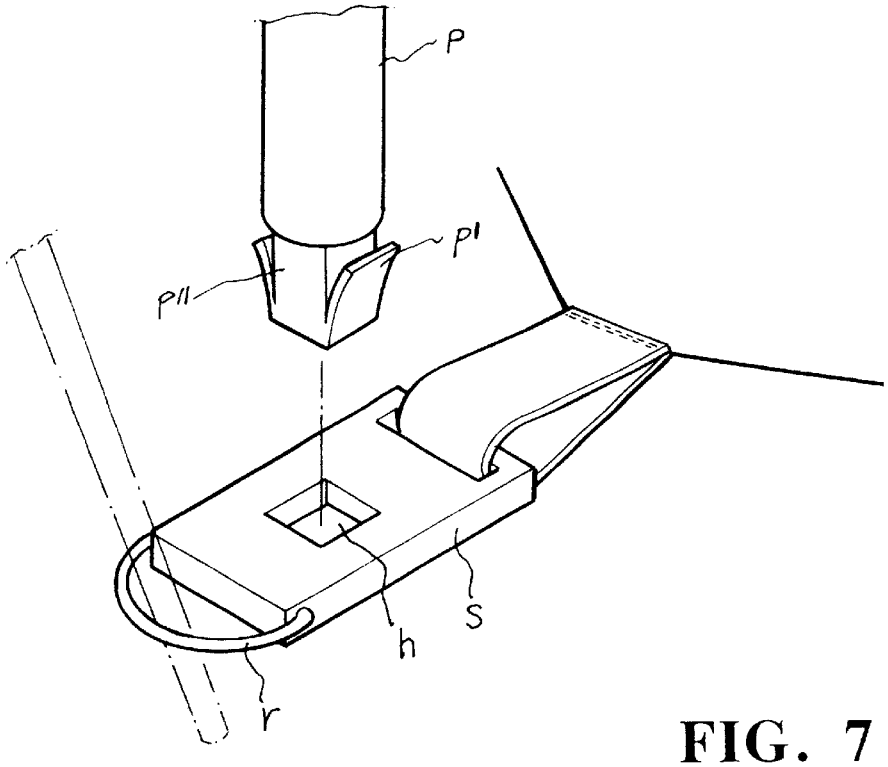
FIG. 6 illustrates a state in which the pole of the conventional foldable tent frame is being coupled to the tent.

The pole-securing means B is basically the same as the conventional foldable tent of FIG. 6. That is, the lower portion of the pole p of the frame f is inserted into a slot 5*a* which is formed at the center of the pole-securing piece 5, and the pole-securing piece 5 has a semi-ring 5*b*. The band 4 passes through the hold 5*c* of the pole-securing piece 5 so as to be connected to the buckle 1 of the detachable means A.

Thus, the detachable means A of the tent is physically connected to the pole securing means B.

If the coupling member 2 is inserted into the buckle 1, then the hooks 2*a* of the coupling member 2 are engaged to the engaging step 1*b*, and therefore, the poles p and the tent cloth t are coupled together. Thus the tent can be installed by one touch manipulation.

Further, the tent can be detached from the tent frame by separating the coupling member 2 from the buckle 1, and then, only the frames f can be unfolded by one touch manipulation. Then the poles p are secured to the ground by driving the stakes through the semi-rings 5*b* of the securing piece 5 into the ground, thereby securing the frames f to the ground. Then only the fly can be coupled to the unfolded frames f as shown in FIG. 3.

The preferred embodiment of the present invention was described referring to the attached drawings, but the present invention is not limited to the drawings. That is, the tent detachable means A can be varied into various types of connecting devices, and the pole-securing means B can also be varied into various types.

According to the present invention as described above, the instant setup foldable tent is provided with the detachable means between the lower portion of the poles and the tent cloth and is also provided with the pole-securing means at the lower portion of the poles. Accordingly, the speediness and the convenience of the instant setup foldable tent are maintained intact, and besides, the tent cloth can be attached to and detached from the tent frames. Therefore, even in the instant setup foldable tent, the tent cloth can be removed, and only the fly, without the tent, can be installed over the frames, thereby improving the usefulness of the instant setup foldable tent.

What is claimed is:

1. An apparatus for detachably coupling a tent cloth from a tent frame, comprising:

a) a pole-securing assembly including a hole for receivingly engaging a lower pole portion of a tent frame member and having a first end portion adapted to be secured to the ground by stakes or pins and a second end portion;

b) a coupling member having a first end portion adapted to be attached to the tent cloth and a second end portion; and wherein c) said coupling member second end portion is detachably connected to said pole-securing assembly second end portion thereby permitting convenient and quick removal of the tent cloth from the tent frame in a pitched condition while said lower pole portion of said tent frame member remains secured to the ground.

2. An apparatus as in claim 1 wherein said pole-securing assembly first end includes a ring portion.

3. An apparatus as in claim 1, wherein:

a) said pole-securing assembly second end portion includes a female buckle with a slot sized for receiving said coupling member second end portion; and b) said coupling member second end portion includes a pair of male tangs biased to engage opposite sides of said female bucked upon full insertion therewithin.

4. An apparatus as in claim 3 wherein said pole-securing assembly further includes a length adjustable strap connecting said pole-securing assembly first end portion and said female buckle.

5. An apparatus for detachably coupling a tent cloth from a tent frame, comprising:

a) a detachable coupling assembly including a female buckle and a male coupling member adapted for quick disconnect connection with said female buckle, said male coupling member having one end adapted to be attached to the tent cloth;

b) a pole-securing member including a hole for receivingly engaging a lower pole portion of a tent frame member and having a first end adapted to be secured to the ground by stakes or pins and a second end portion connected to said female buckle, whereby;

d) detachment of said male coupling member from said female buckle permits convenient and quick removal of the tent cloth from the tent frame while in a pitched condition as said lower pole portion of said tent frame member remains secured to the ground by its engagement within said hole of said pole-securing member.

6. An apparatus as in claim 5 wherein said pole-securing member first end includes a ring portion.

7. An apparatus as in claim 5 which further includes a length-adjustable strap connecting said pole-securing member second end portion to said female buckle.

8. In an instant setup foldable tent of the kind which includes a plurality of foldable tent frame members extending from a central hub, a tent cloth coupled to the tent frame members such that the tent can be pitched instantly by unfolding the tent frame members by a one-touch operation, the tent cloth having strap members adapted to be anchored to the ground by stakes or pegs, the strap members having pole-securing means for securing a lower pole portion of a respective tent frame member when the tent frame members are unfolded and moved into an erected state, wherein the improvement comprises:

tent cloth detachable means provided to the strap members and being effective to permit detachment of the tent cloth from the respective tent frame member lower pole portions when the tent is in the erected state such that lower pole portions of the tent frame members remain anchored to the ground via the pole-securing means.

9. The invention of claim 2 wherein said tent detachable means comprises a buckle and a coupling member that is detachably connected between the tent and the pole-securing means.

10. The invention of claim 8 wherein the pole-securing means comprises a pole-securing piece having a slot and wherein the pole is anchored to the ground at said slot and wherein the pole-securing piece is connected to said tent cloth detachable means.

* * * * *